United States Patent [19]

Diemi

[11] 4,290,294

[45] Sep. 22, 1981

[54] METHOD FOR PRODUCING AEROSOL CAN TOPS

[75] Inventor: Werner Diemi, Bern, Switzerland

[73] Assignee: Styner & Bienz AG, Niederwangen, Switzerland

[21] Appl. No.: 18,369

[22] Filed: Mar. 7, 1979

[30] Foreign Application Priority Data

Mar. 8, 1978 [CH] Switzerland ..... 2506/78

[51] Int. Cl.[3] ..... B21D 22/00

[52] U.S. Cl. ..... 72/348; 72/327; 72/338

[58] Field of Search ..... 72/348, 339, 334, 335, 72/329, 338, 328, 327; 113/120 P, 120 T, 121 E; 225/2, 94

[56] References Cited

U.S. PATENT DOCUMENTS 790,735 5/1905 Martin ..... 225/2 X
1,173,793 2/1916 George ..... 72/348 X
3,706,292 12/1972 Saunders ..... 113/1 G
4,027,612 6/1977 Herbst ..... 113/121 C

FOREIGN PATENT DOCUMENTS 1329583 9/1973 United Kingdom .

*Primary Examiner*—Leon Gilden
*Attorney, Agent, or Firm*—Wender, Murase & White

[57] ABSTRACT

A method of making the opening in aerosol can tops in two operations on a transfer press. One operation produces a score line on the upper radius of the pre-drawn cylindrical portion which compresses the material and permits a clean and burr-free separation. In the following station the disc is pulled radially towards the center, formed into a cup and ejected downwards. The fact that the material is being compressed in the scoring operation, that the edge thickness is equal to the original material thickness and that the edge of the opening is clean, smooth and free of burrs, permits the subsequent formation of the curl without the risk of splitting when using harder and less expensive material.

3 Claims, 12 Drawing Figures

FIG. 1
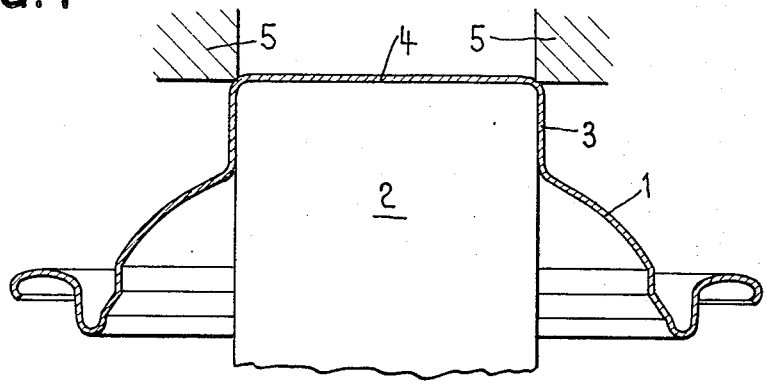
FIG. 2
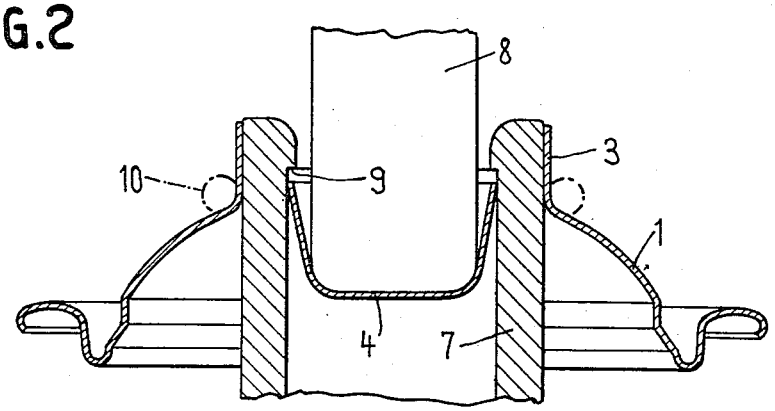
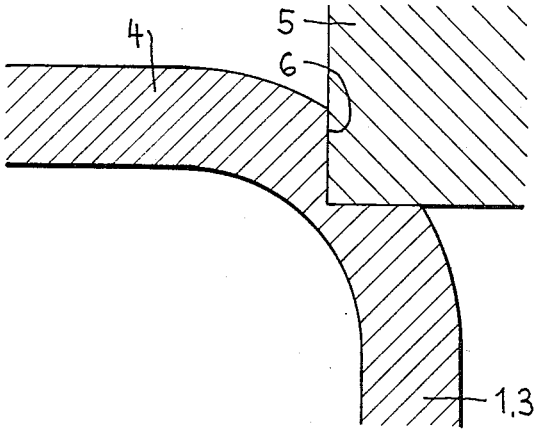
FIG. 3

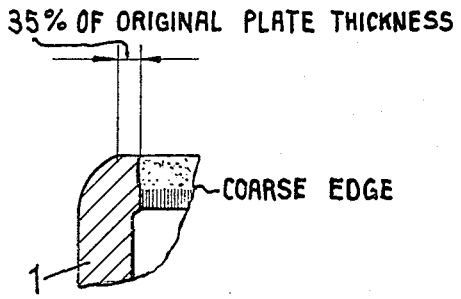
FIG.8
(PRIOR ART)
FIG.7
(PRIOR ART)
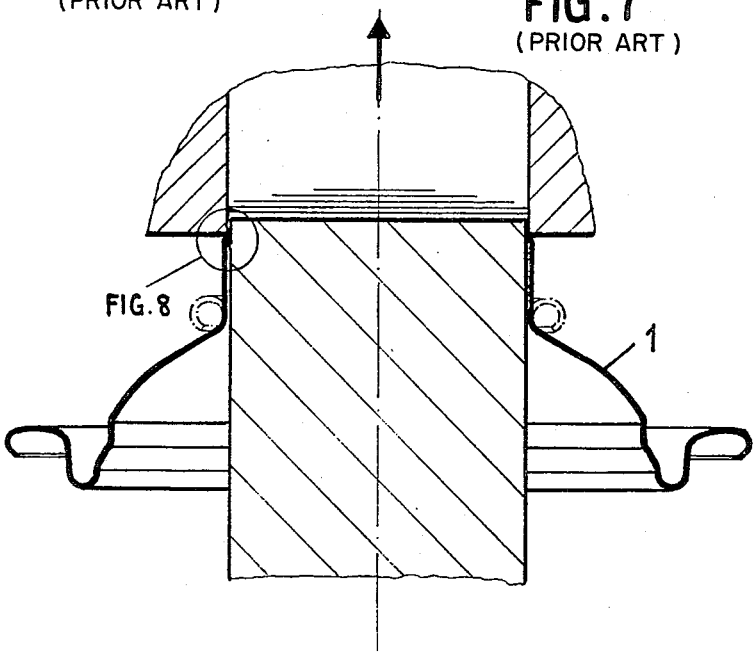

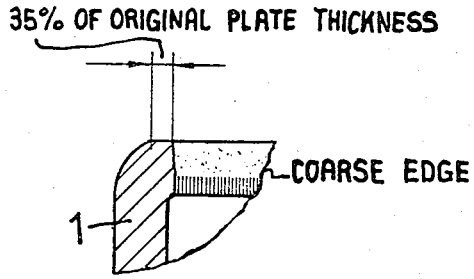
FIG. 10
(PRIOR ART)
FIG. 9
(PRIOR ART)
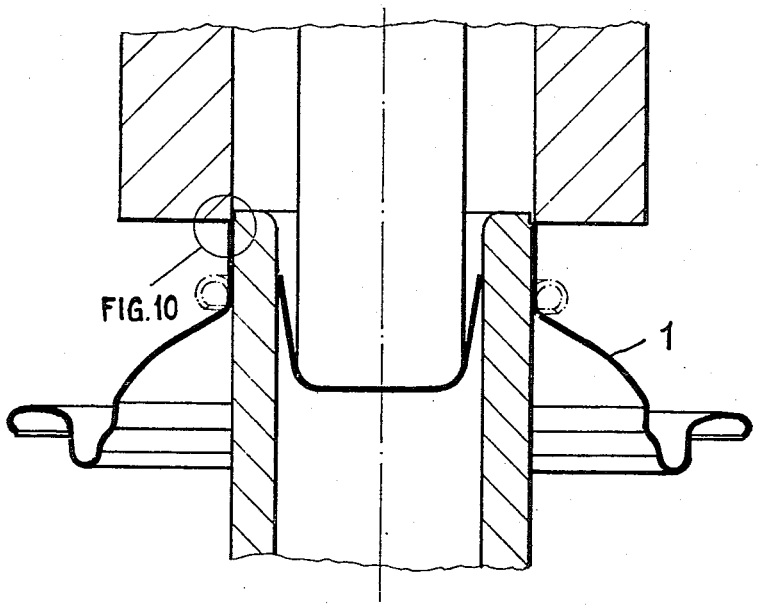

METHOD FOR PRODUCING AEROSOL CAN TOPS

BACKGROUND OF THE INVENTION

To achieve an efficient production of aerosol tops from T-3 (Temper-3) plate or even harder plate, it is absolutely necessary to have a smooth edge without any shear or tear marks on the opening of the upper cylindrical part. An absence of a perfectly smooth edge will result into a cracked curl in the subsequent curling operation which will make the component a reject. With the four conventional piercing methods presently used, the means of counter acting the cracking or splitting tendency of the curls during the curling operation, is to use relatively soft plate. This would be mostly T-1 plate.

T-3 plate is about 8% cheaper than T-1 plate. Due to the fact that the harder plate (T-3 or T-4) has a greater tensile strength, thinner plate can be used without reducing the inside pressure resistance of the aerosol top. This results into another 6% material cost reduction.

PRIOR ART

There are four methods presently used to produce the one inch diameter opening in the aerosol top components.

Method number one punches a 0.875" diameter hole into the component 1 (FIG. 4) and expands this opening to the 1.000" diameter in the following operation (FIG. 5). This is the most commonly used method. The pierced edge is coarse as shown in FIG. 6 since the shearing (piercing) action cannot produce a smooth edge. The opening is expanded from the 0.875" diameter to the outside diameter of the curl which is 1.228". This is a 40% linear expansion of the edge.

Method number two punches an opening only slightly smaller than the required one inch diameter as shown in FIG. 7. The pierced edge is coarse as shown in FIG. 8. The width of the upper edge is only 35% of the original material thickness. This, together with the coarse pierced edge, increases the risk of cracking when the curl is being formed. The opening is expanded from the 1.000" diameter to the outer diameter of the curl which is 1.228". This is a 23% linear expansion of the edge.

Method number three differs from the method number two only in the fact that the punched disc is formed into a cup and ejected downwards (FIG. 9). The coarse surface of the pierced edge and the thin upper edge remain the same as shown in FIG. 10. The linear expansion of the edge during the subsequent curling operation is again 23%.

Method number four does not pierce the one inch opening, it tears out the round disc as shown in FIG. 11. The lower central part is not a punch, it has a radius on its upper edge. There is no cutting edge acting against this part. The component is clamped while the round disc is being torn out. The resulting edge of the opening is thin and extremely coarse as illustrated in FIG. 12. The linear expansion of the edge during the subsequent curling operation is 23%.

Experiments have shown that with all prior methods as briefly illustrated above, appreciable residual tensile stresses remain in the rim of the opening and that such tensile stresses are another reason for the cracking or splitting tendency of the material when the curls are formed. Therefore, it was impossible to make use of relatively hard and cheap material.

SUMMARY OF THE INVENTION

This invention aims in reducing the tendency of splitting or cracking of the material during the curling operation and thereby to allow the use of harder and cheaper material. It has been found that this may be achieved by forming a score line prior to removing the central portion, whereafter the central portion is torn off along the score line. In this case the tensile stresses occuring during the tearing of the material are substantially reduced and due to the deformation of the material under appreciable pressure during forming of the score line, the rim of the opening formed in the blank is under residual compressive stresses instead of having residual tensile stresses as in the prior methods. Further the edge formed along the score line after the central portion has been torn off is very smooth due to the score line. Therefore, much harder and cheaper material may be used than with prior methods, as set out above.

BRIEF DESCRIPTION OF THE DRAWING

This invention will now be explained in detail with reference to the drawings wherein FIG. 1 illustrates a first stage of the method, FIG. 2 shows another stage of the method, FIG. 3 shows a portion of FIG. 1 at a larger scale, and FIGS. 4 to 12 illustrate the prior art.

DESCRIPTION OF A PREFERRED FORM OF THE METHOD

Figure 6:
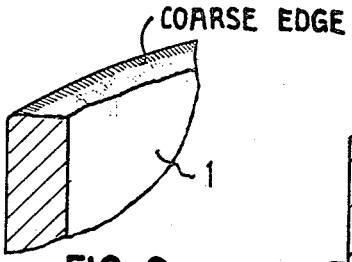
FIG. 6 (PRIOR ART)
Figure 4:
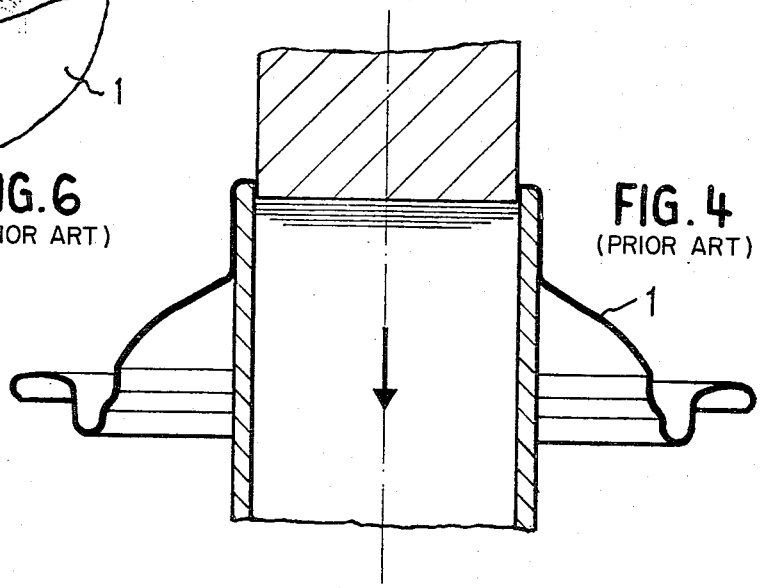
FIG. 4 (PRIOR ART)
Figure 5:
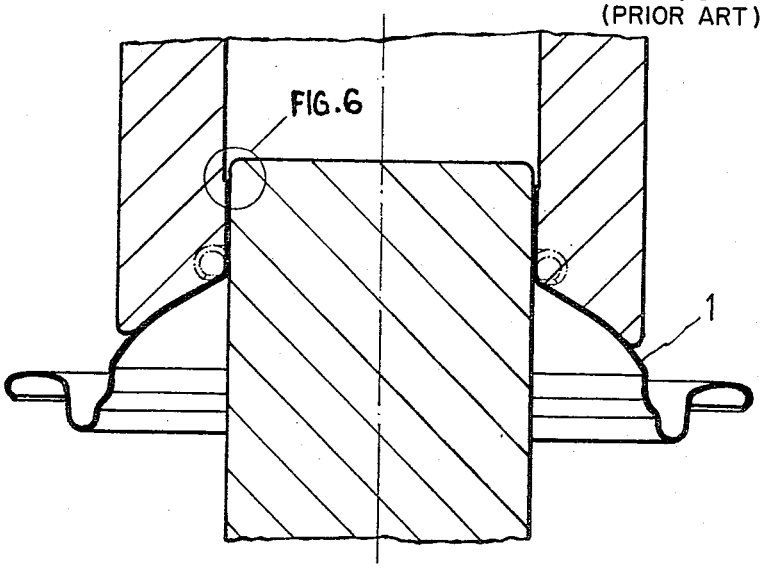
FIG. 5 (PRIOR ART)
Figure 11:
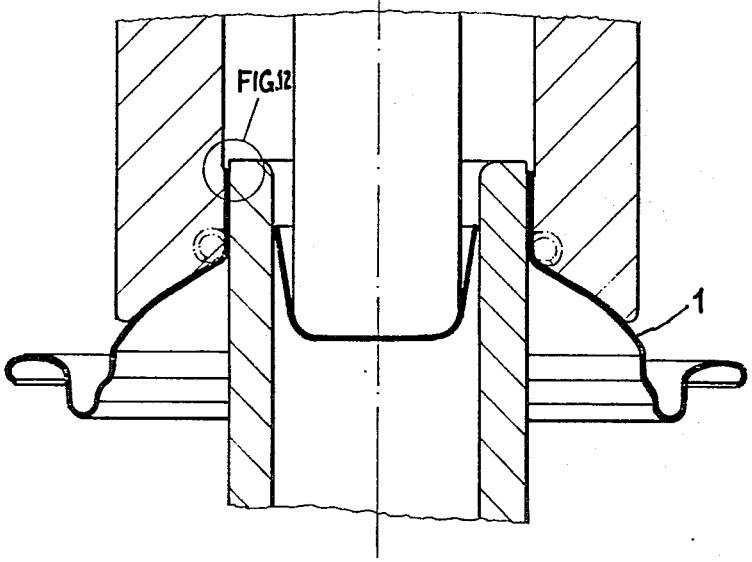
FIG. 11 (PRIOR ART)
Figure 12:
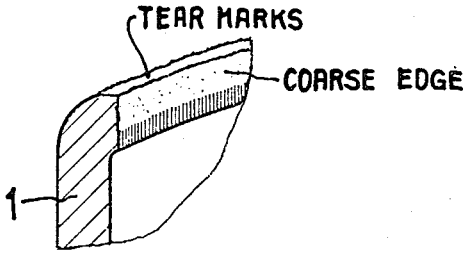
FIG. 12 (PRIOR ART)

According to this invention, the aerosol can top 1 is deep-drawn to the funnel-shape as shown in FIG. 1 and as is well known in the art. This top is placed onto an arbor 2 of which the diameter is equal to the inner diameter of the cylindrical portion 3 of the top and on which the rounded edge portions between the cylindrical portion 3 and the bottom 4 are supported as shown in FIG. 3. A ring shaped tool 5 is now lowered against the top 1, whereby the edge of the tool forms a V-shaped score line 6 substantially in the middle of the rounded portion between the cylindrical portion 3 and the bottom 4. The angle formed between the walls of the V-shaped groove or score line is preferably selected in the order of 90°, and it might even be greater. In any case it is important that a groove or score having a relatively wide opening or angle is formed whereby an appreciable volume of material is displaced laterally and substantial deformation and compressive stresses are produced in the adjacent zones of portions 3 and 4. The favorable effect of this deformation and of the compressive stresses produced thereby as well as of the smooth surface of the rim of the opening formed in the top have already been discussed above.

The top 1 with the score 6 formed therein is then transfered to the next station of the tool where it is placed onto a hollow arbor or sleeve 7. By means of an arbor 8 lowered from above the bottom 4 is now pressed down into and through the hollow sleeve 7 whereby the bottom is torn off the cylindrical portion 3 along score line 6. The deep-drawn bottom 4 thereby is pushed downwardly below a shoulder 9 of the bore of the sleeve 7 and cannot return upwardly when the arbor 8 is subsequently lifted. The separation of the bottom 4 from cylindrical part 3 is effected by forces acting radially inwardly, and such forces are relatively small due to the score line 6 such that the compressive stresses mentioned above remain practically unchanged at the upper remaining rim of cylindrical portion or collar 3.

Care is taken that the score line 6 may be as deep as possible so that the thickness of the material remaining below the score line is in the order of 0.06 to 0.08 mm. Therefore, tensile stresses will only occur on this small residual thickness of material when the bottom 4 is torn off, but this cannot compensate or appreciably reduce the effect of the previously produced compressive stresses. Further, an appreciable portion of the rim remains entirely smooth.

The top is then removed from sleeve 7, and its cylindrical portion or collar 3 is then curled in a further station of the tool in a manner well known in the art. The curl is indicated in FIG. 2 at 10 in dash-dotted lines.

ADVANTAGES OF THE INVENTION

The primary advantage resulting from the new method of producing the opening is that a material cost saving of 8 to 14% can be realized. The reasons for being able to achieve this are as follows:

1. The scoring operation compacts the material under the edge and creates a compressive strain in the material. The result of this is that the subsequent expansion of the material in the curling operation is less severe.

2. The scoring operation produces a smooth edge without shear or tear marks which would facilitate the start of a split.

3. It is well known that thinner edges are much more susceptible to cracking under expansion. The fact that the edge stays as thick as the original material greatly contributes to the splitting or cracking resistance of the edge.

Another advantage may be seen in the fact that it is unnecessary to provide tool portions 2, 5, 7 and 8 of very high precision, because such portions will never directly contact each other. They may thus be made of very hard material and the wear is low and the lifetime of the tools is accordingly high.

What I claim is:

1. A method for producing an aerosol can top, wherein a plate is deep-drawn to form a funnel-shaped member having a cylindrical portion closed at one end by a contiguous central portion, then the central portion is removed, and then the rim of the opening is curled, the improvement wherein the removal of the central portion comprises the steps of:

providing a tool having a compression edge;

axially pressing said tool edge into the plate for forming therein at the boundry between the cylindrical portion and the central portion a groove solely by compression of the material of the plate by said compression edge, thereby producing compressive stresses in the plate along said impressed groove; and tearing off the central portion along said impressed groove leaving said cylindrical portion with a compressively prestressed open end which thereafter may be outwardly curled without splitting.

2. A method according to claim 1, wherein said impressed groove is a V-shaped groove of which the sides are at an angle of 90°.

3. A method according to claims 2 or 1, wherein said central portion is pushed out through a hollow supporting sleeve, said central portion being thus torn off radially inwardly along said impressed groove.

* * * * *